US009181940B2

(12) United States Patent
Cullen, Jr. et al.

(10) Patent No.: US 9,181,940 B2
(45) Date of Patent: Nov. 10, 2015

(54) COMPRESSOR BASEPLATE WITH STIFFENING RIBS FOR INCREASED OIL VOLUME AND RAIL MOUNTING WITHOUT SPACERS

(75) Inventors: James G. Cullen, Jr., Manlius, NY (US); Ronald J. Duppert, Fayetteville, NY (US); Kurt William Robert Bessel, Mexico, NY (US); Xianghong Wang, Syracuse, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 566 days.

(21) Appl. No.: 13/427,984

(22) Filed: Mar. 23, 2012

(65) Prior Publication Data

US 2013/0251550 A1 Sep. 26, 2013

(51) Int. Cl.

| | |
|---|---|
| ***F04B 39/12*** | (2006.01) |
| ***F04C 23/00*** | (2006.01) |
| ***F04B 39/00*** | (2006.01) |

(52) U.S. Cl.

CPC ..... *F04B 39/121* (2013.01); *F04B 39/0044* (2013.01); *F04C 23/008* (2013.01)

(58) Field of Classification Search

CPC .... F04B 39/12; F04B 39/121; F04B 27/0446; F04B 27/1081; F04B 39/023; F04B 53/16; F04B 39/044; F03C 23/008; F04C 2240/30

USPC ..... 417/423.15, 360, 361

See application file for complete search history.

(56) References Cited

U.S. PATENT DOCUMENTS

| | | | | |
|---|---|---|---|---|
| 35,216 | A | 5/1862 | Carton | |
| 5,342,185 | A | 8/1994 | Anderson | |
| 5,407,335 | A | 4/1995 | Caillat et al. | |
| 5,427,511 | A | 6/1995 | Caillat et al. | |
| 5,466,136 | A * | 11/1995 | Yamada et al. | 418/55.6 |
| 5,482,450 | A | 1/1996 | Caillat et al. | |
| 5,580,230 | A | 12/1996 | Keifer et al. | |
| 5,897,306 | A | 4/1999 | Beck | |
| 6,247,909 | B1 * | 6/2001 | Williams et al. | 418/55.1 |
| 6,254,365 | B1 * | 7/2001 | Nakanishi | 417/572 |
| 6,293,767 | B1 | 9/2001 | Bass | |
| 6,398,530 | B1 | 6/2002 | Hasemann | |
| 6,560,868 | B2 | 5/2003 | Milliff et al. | |
| 6,648,616 | B2 | 11/2003 | Patel et al. | |
| 6,695,201 | B2 * | 2/2004 | Narasipura et al. | 228/245 |
| 6,761,541 | B1 * | 7/2004 | Clendenin | 417/360 |

(Continued)

OTHER PUBLICATIONS

U.S. Appl. No. 13/427,984, filed Mar. 23, 2012, Cullen et al.

(Continued)

*Primary Examiner* — Justin Jonaitis
*Assistant Examiner* — Charles Nichols
(74) *Attorney, Agent, or Firm* — Reinhart Boerner Van Deuren P.C.

(57) ABSTRACT

A compressor that includes a housing with a plurality of attached shell sections which define an internal volume of the compressor. In the housing, compressor bodies have respective surfaces which mutually engage. The compressor includes a drive unit disposed in the housing. The drive unit has a motor to provide a mechanical output on a drive shaft. The drive shaft drives one of the compressor bodies to facilitate relative movement for the compression of fluid. In an embodiment, the plurality of shell sections includes a base plate having an annular rib, which locates a tubular central shell section of the plurality of attached shell sections.

14 Claims, 8 Drawing Sheets

(56) References Cited

U.S. PATENT DOCUMENTS

| | | | | |
|---|---|---|---|---|
| 6,814,551 | B2 | 11/2004 | Kammhoff et al. | |
| 6,948,916 | B2 * | 9/2005 | Hebert | 417/360 |
| 6,960,070 | B2 | 11/2005 | Kammhoff et al. | |
| 7,070,397 | B2 * | 7/2006 | Narney et al. | 417/312 |
| 7,070,401 | B2 | 7/2006 | Clendenin et al. | |
| 7,112,046 | B2 | 9/2006 | Kammhoff et al. | |
| 7,281,907 | B2 | 10/2007 | Gilliam et al. | |
| 7,819,638 | B2 | 10/2010 | Grimm et al. | |
| 7,997,877 | B2 | 8/2011 | Beagle et al. | |
| 8,002,528 | B2 | 8/2011 | Hodapp et al. | |
| 8,142,175 | B2 | 3/2012 | Duppert et al. | |
| 2006/0130801 | A1 * | 6/2006 | Suzuki et al. | 123/196 R |
| 2009/0185929 | A1 | 7/2009 | Duppert et al. | |

OTHER PUBLICATIONS

U.S. Appl. No. 13/427,991, filed Mar. 23, 2012, Rogalski.
U.S. Appl. No. 13/427,992, filed Mar. 23, 2012, Bessel et al.
U.S. Appl. No. 13/428,036, filed Mar. 23, 2012, Bush et al.
U.S. Appl. No. 13/428,165, filed Mar. 23, 2012, Heusler.
U.S. Appl. No. 13/428,172, filed Mar. 23, 2012, Roof et al.
U.S. Appl. No. 13/428,173, filed Mar. 23, 2012, Bush.
U.S. Appl. No. 13/428,026, filed Mar. 23, 2012, Roof.
U.S. Appl. No. 13/428,042, filed Mar. 23, 2012, Roof et al.
U.S. Appl. No. 13/428,072, filed Mar. 23, 2012, Wang et al.
U.S. Appl. No. 13/428,337, filed Mar. 23, 2012, Duppert et al.
U.S. Appl. No. 13/428,406, filed Mar. 23, 2012, Duppert.
U.S. Appl. No. 13/428,407, filed Mar. 23, 2012, Duppert et al.
U.S. Appl. No. 13/428,505, filed Mar. 23, 2012, Duppert et al.

* cited by examiner

COMPRESSOR BASEPLATE WITH STIFFENING RIBS FOR INCREASED OIL VOLUME AND RAIL MOUNTING WITHOUT SPACERS

FIELD OF THE INVENTION

This invention generally relates to compressors for compressing refrigerant, and, more particularly, to housings for such compressors.

BACKGROUND OF THE INVENTION

Many conventional compressors use a "bottom shell" (along with a "center shell" and "top shell) to form a pressure containing vessel, or housing. Depending on the refrigerant being used and pressure vessel code being followed, the pressure vessel must be designed to withstand a certain burst pressure as defined in the codes. In many cases, the top and bottom shells of the compressor housing have a domed shape so as to minimize hoop stresses under pressure, and to allow for the use of thinner gauge materials.

In order to mount the compressor, to a piece of HVAC equipment for example, this compressor housing with its dome-shaped bottom must have a means of holding the compressor upright during handling and assembly. Typically, and as shown in the conventional compressors and mounting systems of FIGS. 1 and 2, additional mounting plates or mounting feet 4 are welded (or otherwise suitably attached) to the compressor housing 3 for this purpose. These mounting feet 4 may also be designed to work in conjunction with a vibration isolating grommet, for example, if only one compressor is used in the system or refrigerating circuit. In many conventional HVAC or refrigeration system applications, compressors are used in tandem, trio or even quadro configurations. In such applications, the two, three, or four compressors are typically mounted on a pair of common base rails 5, as shown in FIG. 2, and interconnecting piping (e.g., suction, discharge, and oil equalization) may be used to provide a single common suction and/or common discharge to the rest of the refrigeration system. Typically, the compressors are hard mounted to such rails 5, and the rails 5 are then mounted on vibration isolating rails.

Further, due to the typically domed shape of the bottom shell 6, in many cases the mounting feet 4 must be located on the bottom shell 6 at an elevation that is low enough to hold the compressor upright when placed on a flat surface. This low-mounting foot elevation increases the overall applied height of the compressor. In application, the elevation increase is often made apparent by the presence of adapters 8 and/or spacers 7.

U.S. Pat. No. 6,761,541B1 discloses a footplate for hermetic shell compressors, while U.S. Pat. No. 6,648,616B2 discloses a sealed compressor housing with noise reduction features, the entire teachings and disclosures of which are incorporated herein by reference thereto. U.S. Pat. No. 6,560,868B2 discloses a method of making a lower end cap for scroll compressor, and U.S. Pat. No. 8,002,528B2 discloses a compressor having vibration attenuating structure, while U.S. Pat. No. 7,819,638B2 discloses a compressor mounting system specifically for mobile applications, the entire teachings and disclosures of which are incorporated herein by reference thereto.

Embodiments of the present invention represent an advancement over the state of the art with respect to compressors and the housings therefor. These and other advantages of the invention, as well as additional inventive features, will be apparent from the description of the invention provided herein.

BRIEF SUMMARY OF THE INVENTION

In one aspect, embodiments of the invention provide a compressor that includes a housing with a plurality of attached shell sections which define an internal volume of the compressor. The compressor includes compressor bodies disposed in the housing. The compressor bodies have respective surfaces which mutually engage. The compressor further includes a drive unit disposed in the housing. The drive unit has a motor to provide a mechanical output on a drive shaft. The drive shaft operatively drives one of the compressor bodies to facilitate relative movement for the compression of fluid. In an embodiment of the invention, the plurality of shell sections includes a base plate having an annular rib, which locates a tubular central shell section of the plurality of attached shell sections.

The annular rib may include an annular inner wall, an annular outer wall, and an annular apex which joins the annular inner wall to the annular outer wall, wherein the annular rib further includes an downwardly facing annular channel located between the annular inner wall and annular outer wall, a portion of the annular channel defined by the annular apex.

The base plate may be formed as a single unitary component from sheet metal to provide all of the structure of the annular rib, dome and oil sump (to include the convex central portion), and outer peripheral mounting area. Along the outer peripheral mounting area, the base plate includes at least one flange portion, and a mounting surface. The base plate can be configured to rest on a level surface or to be mounted onto a set of base rails without the use of grommets, spacers, or mounting feet.

The central portion and central bottom region of the base plate can be convex, such that the central portion extends downward when the compressor is right side up. The central portion of the base plate can be bounded on its perimeter by the annular rib, and defines a lower boundary of an oil sump.

In certain embodiments of the invention, the mounting surface of the base plate abuts one end of a tubular shell section such that the annular rib contacts an interior surface at the one end of the tubular shell section. The mounting surface of the base plate is generally flat, extending radially outward from the outer perimeter of the annular rib, and projecting upward from the mounting surface when the compressor is right side up. In a more particular embodiment, the base plate is welded to the tubular shell section.

In at least one embodiment of the invention, the central portion of the base plate is rounded and partly spherical in shape. In an alternate embodiment, the central portion of the base plate has a flattened but convex bottom portion surrounded by angled sides. In a particular embodiment, the central portion of the base plate has two pairs of opposing angled sides, and one pair of opposing angled sides is slightly concave with an arcuate or linear rib formed into each of those side (concave with respect to the convex central portion), and the other pair of opposing angled sides are arcuate to extend around the central convex bottom but have a generally linear profile when viewed in cross-section.

The mounting surface of the base plate can configured to mount directly onto a set of base rails without a separate mounting plate, wherein the at least one flange portion extends in a direction perpendicular to the mounting surface. The set of base rails includes two substantially parallel base rails, and the at least one flange portions extend between the two substantially parallel base rails. The base plate will typically have a plurality of openings to accommodate fasteners for attaching the base plate to a set of base rails. For most compressors, the base plate will be generally rectangular having four corners, and wherein each corner has at least one of the plurality of openings.

For an embodiment of a scroll compressor, the compressor bodies includes first and second scroll compressor bodies, each of the first and second scroll compressor bodies having a respective base and a respective scroll rib projecting from its respective base, wherein the scroll ribs mutually engage.

According to another inventive aspect, a compressor assembly, comprises a housing that includes a plurality of attached shell sections which define an internal volume of the compressor; and compressor bodies disposed in the housing that have respective surfaces which mutually engage. A drive unit disposed in the housing has a motor to provide a mechanical output on a drive shaft that operatively drives the compressor bodies to facilitate relative movement for the compression of fluid. In accordance with this aspect, the plurality of shell sections includes a base plate formed of sheet metal to include a central dome providing an oil sump, the central dome having at least one rib formed into the sheet metal to interrupt an otherwise smooth dome shape of the central dome. The at least one rib may be linear or arcuate to follow the general curvature of the dome.

The at least one rib can comprise a pair of ribs on opposing sides of the dome. Further, the dome may include first and second pairs of sides connecting an annular rib to a central convex bottom that is convex along an outside surface of the housing. For these connecting sides between the annular rib and the convex bottom, the second pair of sides are shorter and angled steeper than the first pair of connecting sides, with ribs being formed into the first pair of sides. Somewhat flattened and triangular gussets can be formed at the corners connecting adjacent connecting sides.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
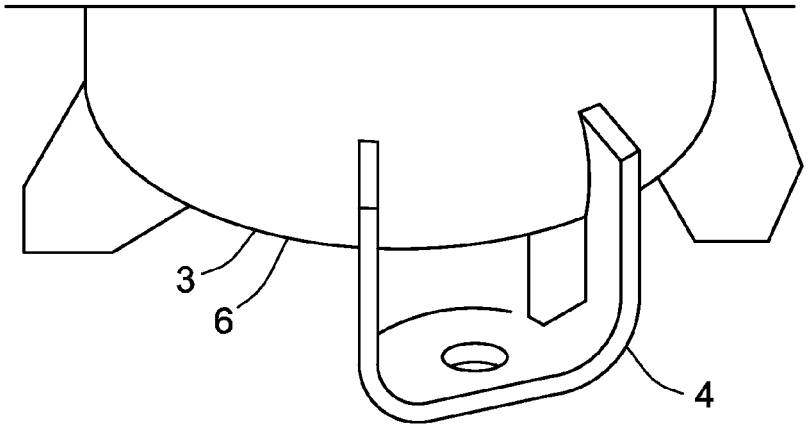
FIG. 1 is an isometric view of a bottom portion of a conventional compressor housing with mounting feet.
Figure 2:
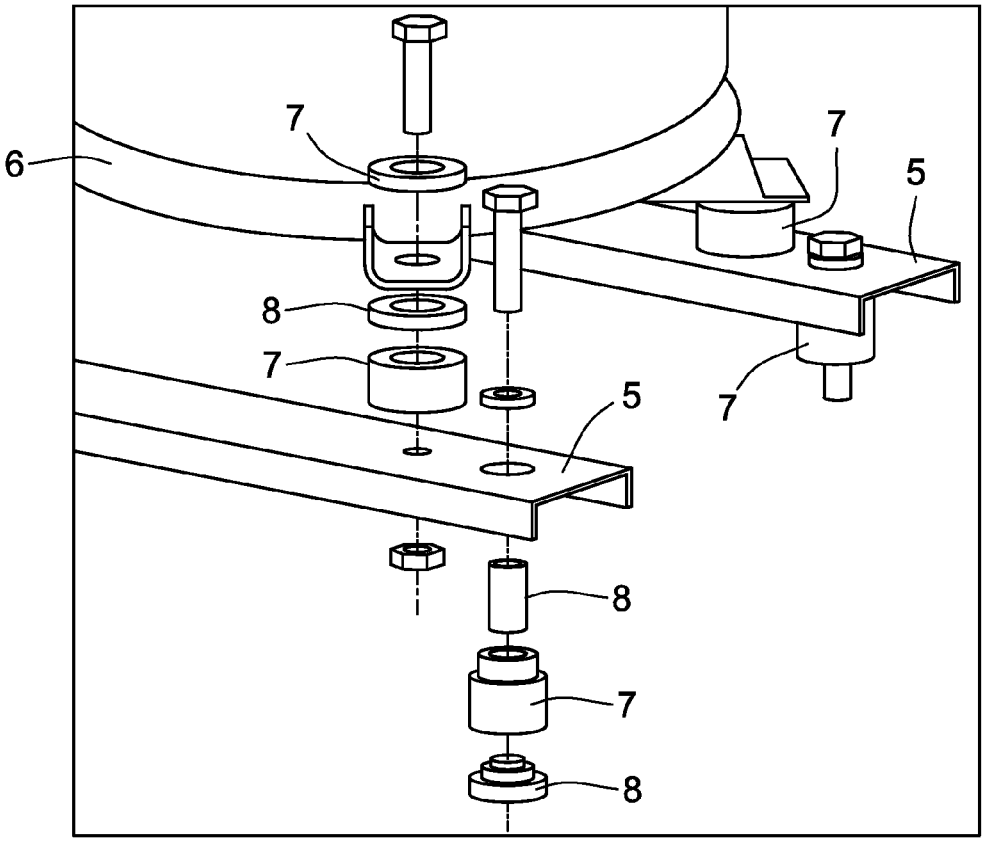
FIG. 2 is an isometric view of conventional mounting rails, adapters, and spacers typically used to support a compressor in an HVAC or refrigeration system.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the invention are frequently described hereinbelow with respect to their application in scroll compressors for compressing refrigerant. However, one of ordinary skill in the art will recognize that these embodiments are not limited to scroll compressors, but may find use in a variety of compressors other than scroll compressors. Nothing disclosed herein is intended to limit the application of the present invention to a particular type of compressor.

An embodiment of the present invention is illustrated in FIGS. 3-6 as a compressor assembly 10 generally including an outer housing 12 in which a compressor apparatus 14 can be driven by a drive unit 16. In the exemplary embodiments described below, the compressor apparatus 14 is a scroll compressor. Thus the terms compressor apparatus and scroll compressor are, at times, used interchangeably herein. The compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The compressor assembly 10 is operable through operation of the drive unit 16 to operate the compressor apparatus 14 and thereby compress an appropriate refrigerant or other fluid that enters the refrigerant inlet port 18 and exits the refrigerant outlet port 20 in a compressed high pressure state.

In an exemplary embodiment of the invention in which a scroll compressor 14 is disposed within the outer housing 12, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The outer housing 12 may take many forms. In a particular embodiment, the outer housing 12 includes multiple housing or shell sections, and, in certain embodiments, the outer housing 12 has three shell sections that include a central housing section 24, a top end housing section 26 and a bottom end housing section, or base plate 28. In particular embodiments, the housing sections 24, 26, 28 are formed of appropriate sheet steel and welded together to make a permanent outer housing 12 enclosure. However, if disassembly of the outer housing 12 is desired, methods for attaching the housing sections 24, 26, 28 other than welding may be employed including, but not limited to, brazing, use of threaded fasteners or other suitable mechanical means for attaching sections of the outer housing 12.

Figure 4:
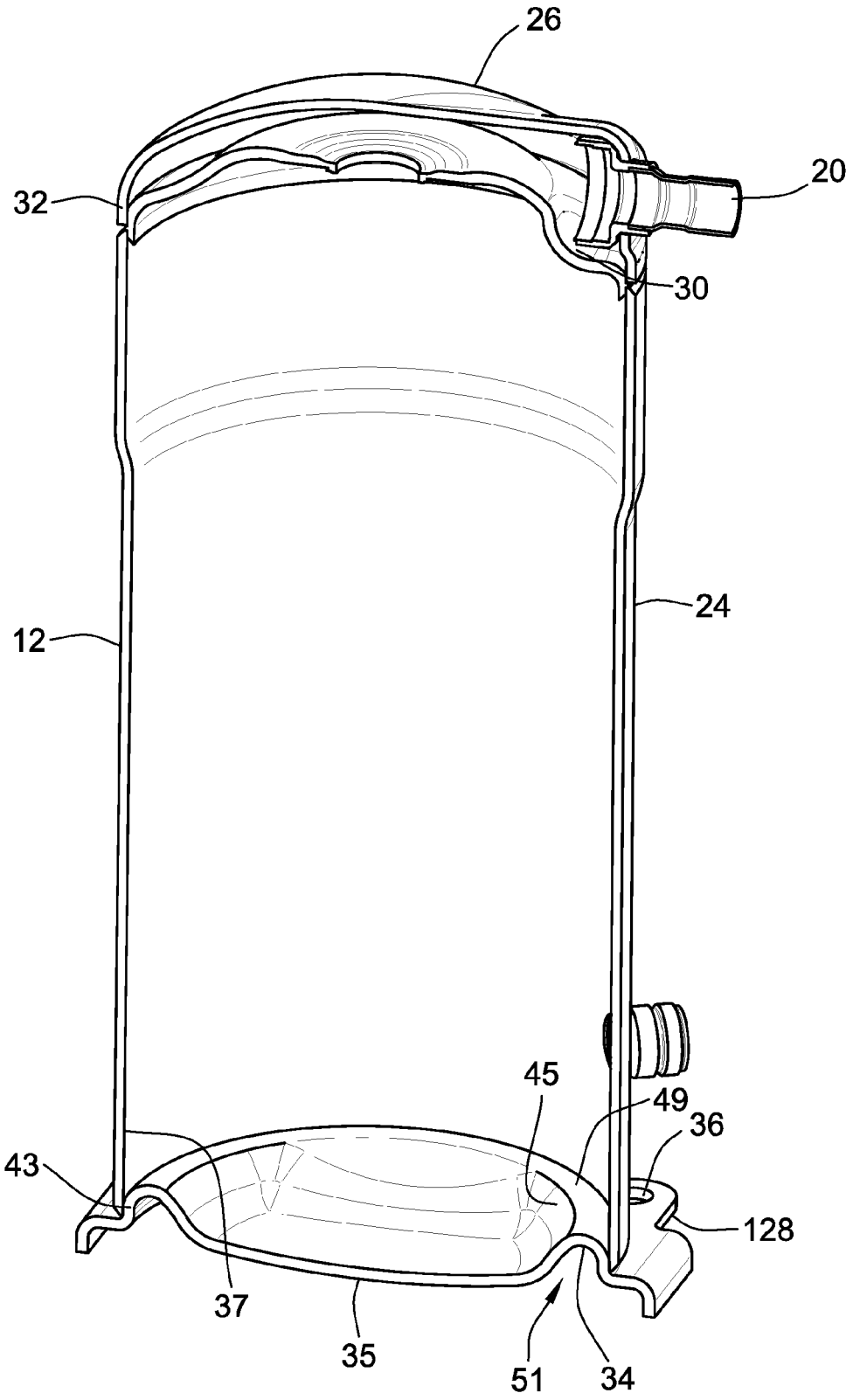
FIG. 4 is a cross-sectional isometric view of the compressor assembly housing of FIG. 3, according to the embodiment of the invention of FIG. 3.
Figure 6:
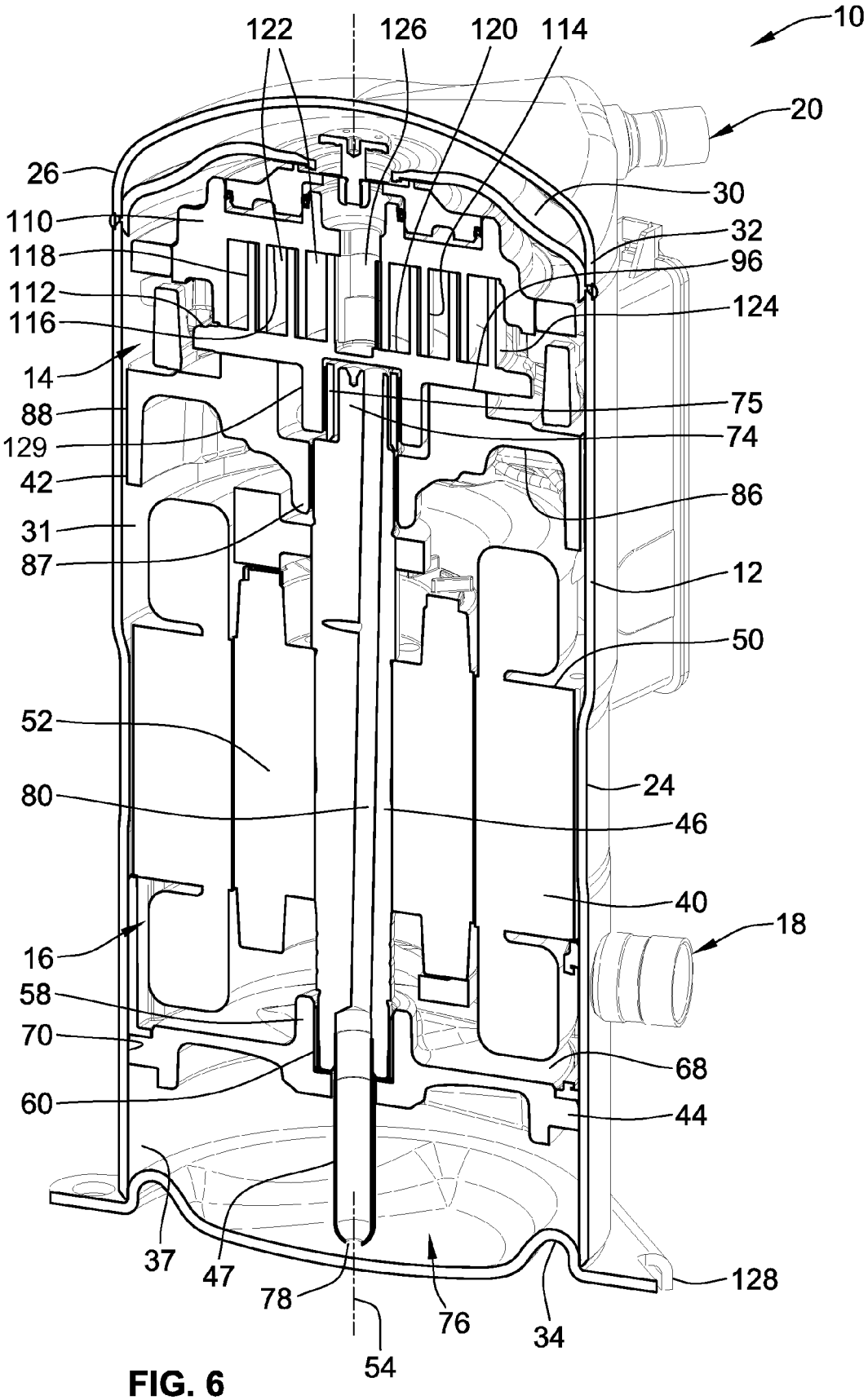
FIG. 6 is a cross-sectional isometric view of a compressor assembly incorporating a mounting base plate, constructed in accordance with an embodiment of the invention.

The central housing section 24 is preferably tubular or cylindrical and may abut or telescopically fit with the top and bottom end housing sections 26, 28. As can be seen in the embodiments of FIGS. 4 and 6, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. While the top end housing section 26 is generally dome-shaped and includes a cylindrical side wall region 32 to mate with the center housing section 24 and provide for closing off the top end of the outer housing 12, in particular embodiments, the bottom end housing section (hereinafter, also referred to as a mounting base plate) 28 is generally flat with an annular rib 34 that locates the bottom end of the central housing section 24. As shown in FIG. 6, assembly of the outer housing 12 results in the formation of an enclosed chamber 31 that surrounds the drive unit 16, and partially surrounds the compressor apparatus 14.

Figure 5:
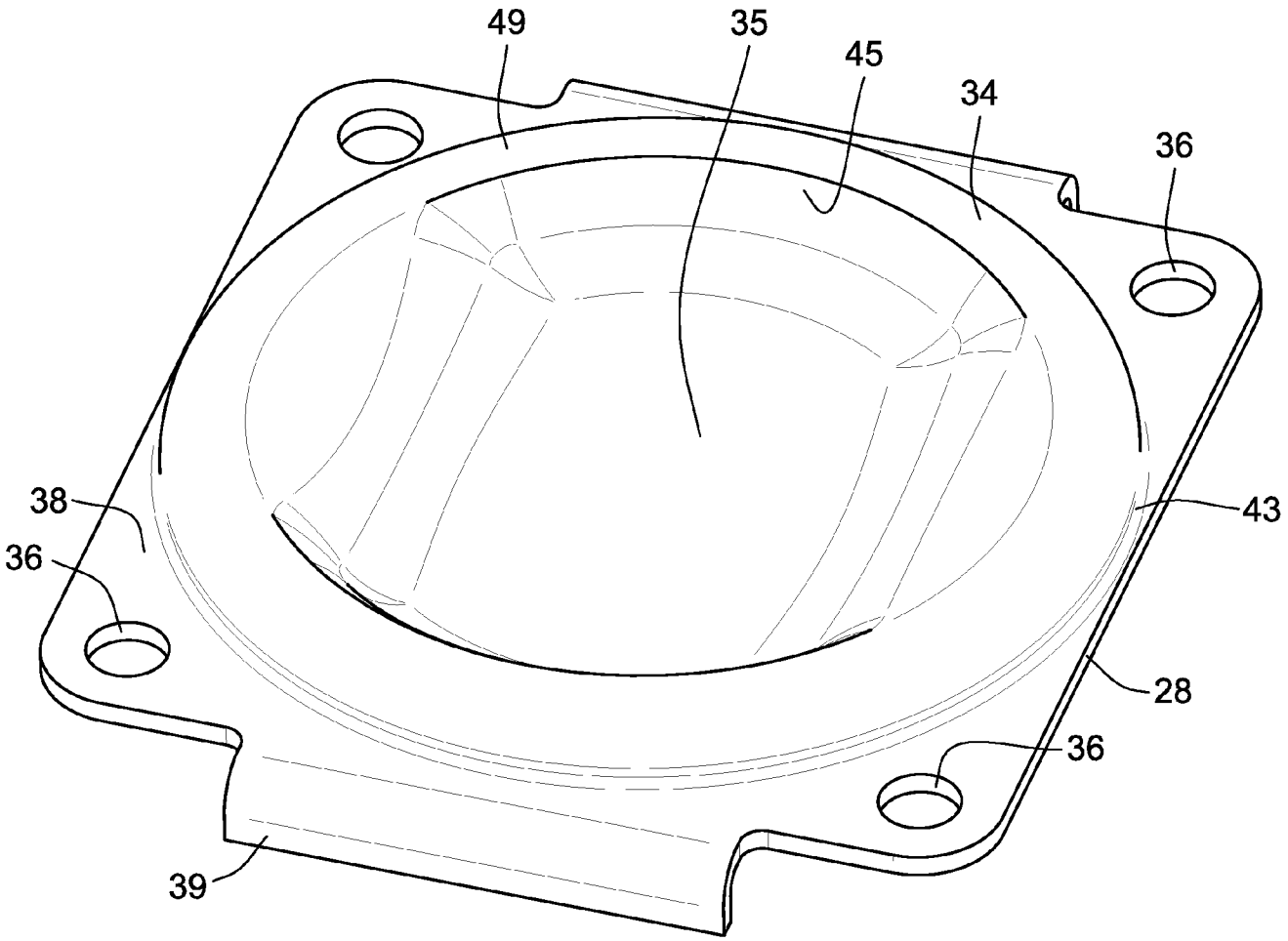
FIG. 5 is an isometric view of the mounting base plate for the compressor assembly housing of FIG. 4.

In a particularly advantageous embodiment of the invention, the mounting base plate 28 is made as a single unitary component from sheet metal, and the annular rib 34 is stamped into the sheet metal. The annular rib 34 projects perpendicularly to a mounting surface 38. The mounting surface 38 includes a generally planar region with a flat surface portion of the mounting base plate 28 outside of the annular rib 34. In the embodiment of FIG. 5, the annular rib 34 projects upward from the mounting surface 38 (when the mounting base plate 28 is right side up, as in FIG. 5). The annular rib 34 has an annular outer wall 43, an annular inner wall 45, and an annular apex 49 that joins the annular outer wall 43 to the annular inner wall 45, all being integrally formed from sheet metal via stamping operations. On the bottom side of the mounting base plate 28, a downwardly facing annular channel 51 runs between the annular outer wall 43 and the annular inner wall 45. As can be seen in FIG. 4, a portion of the annular channel 51 is defined by the annular apex 49.

Further, the mounting base plate 28 includes a convex center portion 35 and convex bottom which allows for an increased oil volume in the compressor assembly 10, as compared to conventional compressors. In the embodiment of FIGS. 4 and 5, the center portion 35 is rounded with a partially spherical or at least convex shape and a smooth cross-sectional profile. The convex bottom of the center portion 35 defines the bottom of an oil sump 76 in the compressor assembly 10.

The mounting base plate 28 further includes at least one stiffening flange 39. In the embodiment shown in FIG. 5, the mounting base plate 28 includes two stiffening flanges 39 which are bent downward (in the orientation of FIG. 5) such that the two stiffening flanges 39 add lateral strength to the mounting base plate 28, which is especially advantageous when the mounting base plate 28 is mounted to a set of base rails 41 (see FIG. 7), for example, which support one or more of the compressor assemblies 10 in the HVAC or refrigeration system. In certain embodiments, the set of base rails 41 includes two substantially parallel rails, and the stiffening flange(s) 39 extend transversely between the parallel set of base rails 41.

Figure 3:
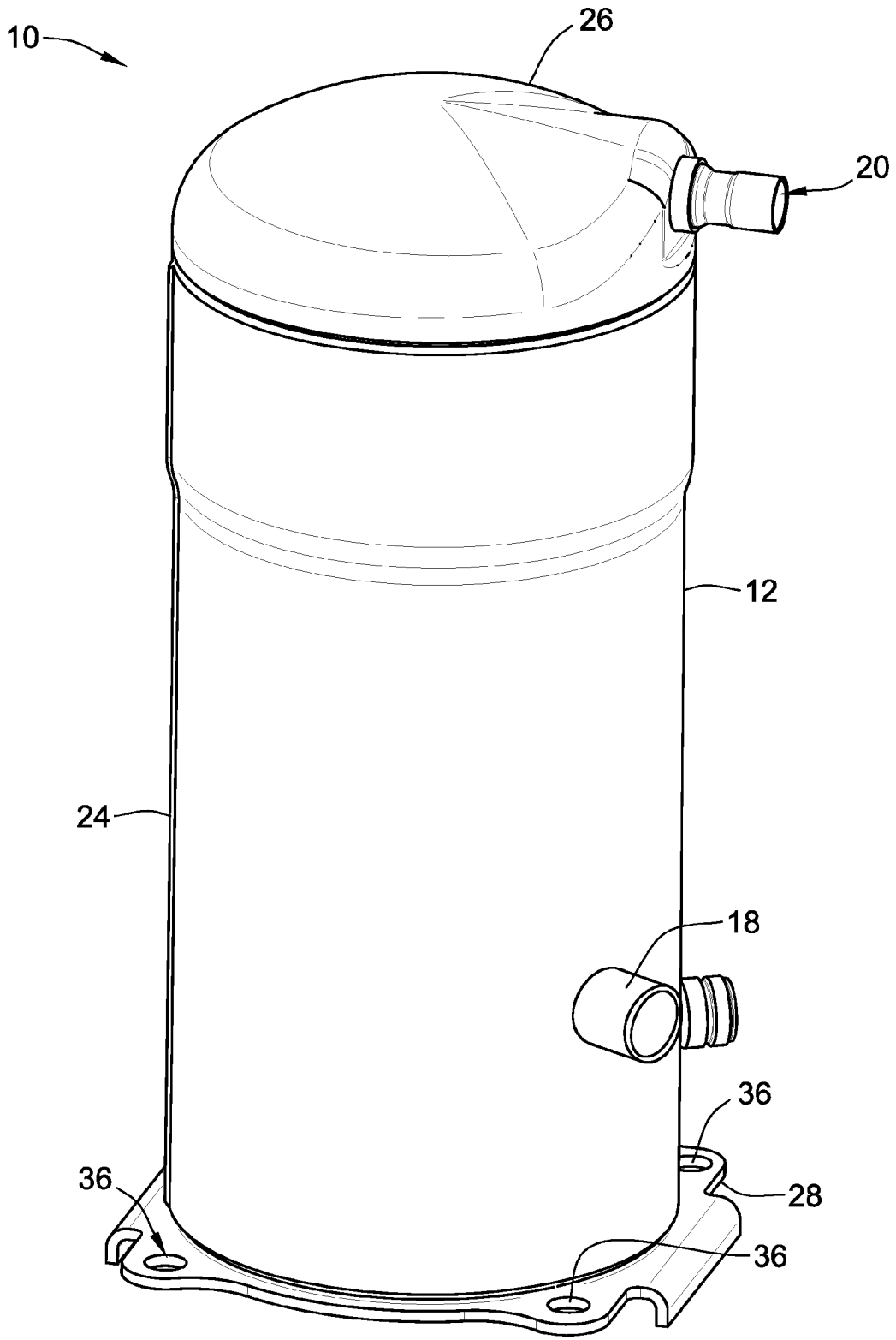
FIG. 3 is an isometric view of a compressor assembly, constructed in accordance with an embodiment of the invention.

As can be seen in FIG. 4, the side wall region 32 of the top end housing section 26 is attached to the central housing section 24. In certain embodiments, the fit between to central and top end housing sections 24, 26 may be telescopic fit, though, in alternate embodiments, the two housing sections sit flush against each other. As referred to above, in particular embodiments, there is an exterior weld along a circular weld region where the top end housing section 26 and the central housing section 24 meet. As shown in FIGS. 3 and 4, the annular rib 34 of the mounting base plate 28 abuts an interior surface 37 of the central housing section 24. The bottom end of the central housing section 24 rests on a generally flat mounting surface 38 of the mounting base plate 28. In a further embodiment, the mounting base plate 28 is welded to the central housing section 24 about the exterior circumference of the central housing section 24.

In many conventional compressors, such as that illustrated in FIG. 1, the mounting feet can be welded on (or otherwise suitably attached) individually, in a structure that results in pairs, or as a plate with three or four mounting locations applied all at once. Some of these compressors include the three or four mounting feet as part of the bottom shell, but require spacers to be added in order to mount directly to the refrigeration system or HVAC structure.

Embodiments of the mounting base plate 28, as illustrated in FIG. 5, provide a bottom shell with an annular rib that combines the function of bottom end housing section and mounting plate in such a way as to increase the internal volume of the shape (e.g., oil volume) without needing to increase the applied height of the compressor assembly 10. Further, the mounting base plate 28 includes an annular rib 34 that adds structural strength to the mounting base plate 28, and provides for centering and attachment to the central housing section 24. In the embodiment of FIG. 5, the mounting base plate 28 is rectangular, with four openings 36 in each corner of the mounting base plate 28. The openings 36 are located in the mounting surface 38, and are configured to accommodate fasteners, such as bolts, for securing the mounting base plate 28 and compressor assembly 10 to a flat surface or to a set of rails. Alternate embodiments of the mounting base plate may have greater or lesser than four openings.

Figure 7:
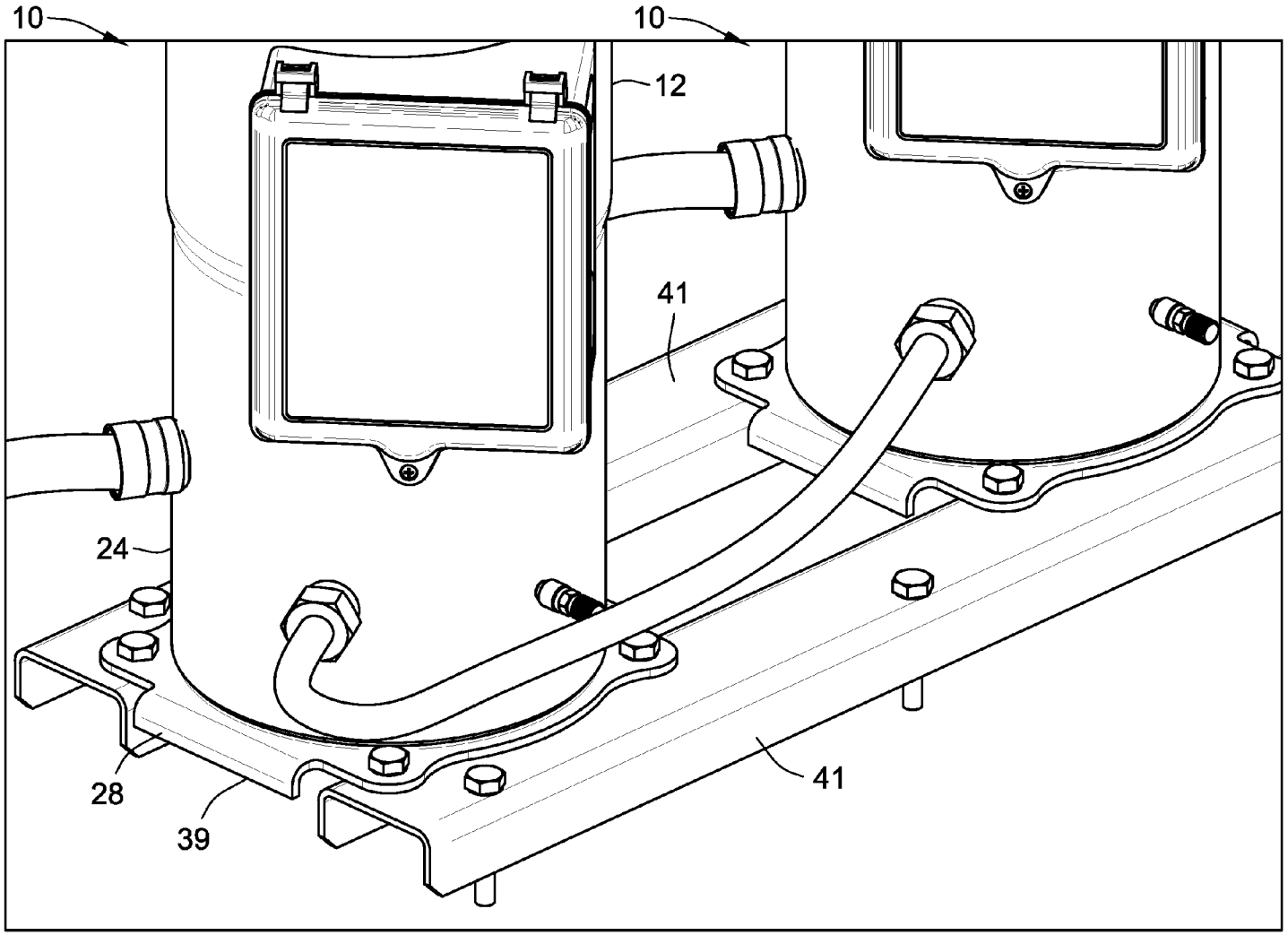
FIG. 7 is an isometric view of a compressor incorporating a mounting base plate, wherein the compressor is mounted on base rails.

The mounting base plate 28 of FIG. 5 has two stiffening flanges 39 bent downward (when oriented as shown in FIGS. 5 and 7) to strengthen the mounting base plate 28 allowing it to hold the compressor assembly 10 upright when placed on a flat surface or when mounted to a set of base rails 41, as shown in FIG. 7. The combination of the annular rib 34 and stiffening flanges 39 provides structural strength to the mounting base plate 28. This allows the mounting base plate to be fabricated from sheet metal that is not as thick as would be necessary without these strengthening features. As a result, the base plate 28 can be relatively lightweight and inexpensive to manufacture.

Figure 8A:
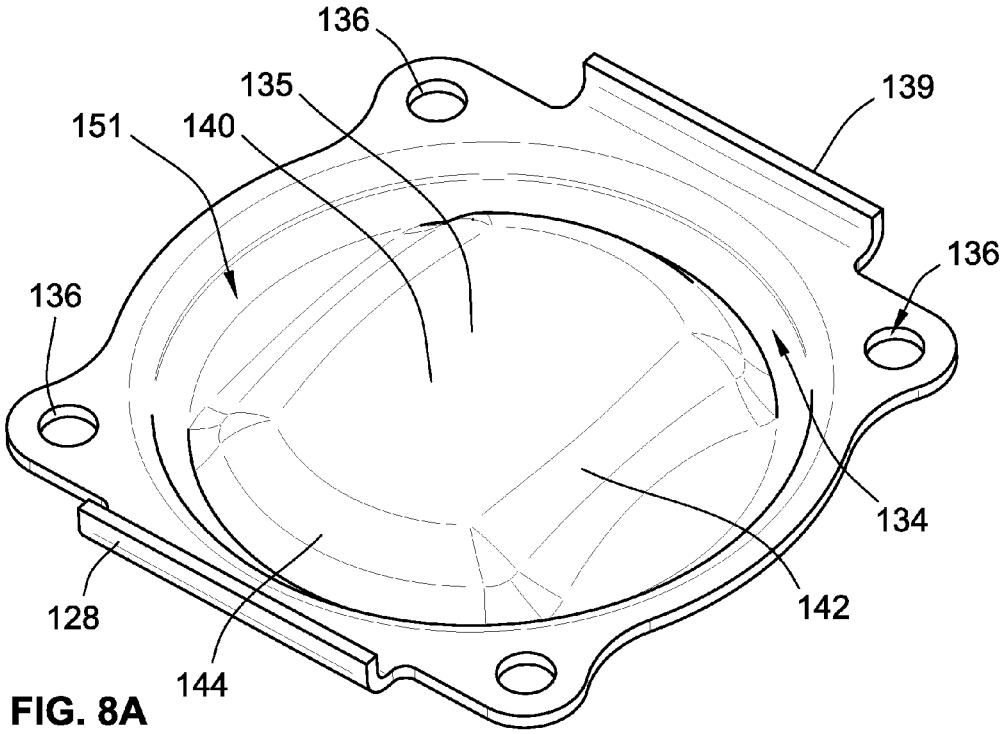
FIGS. 8A and 8B are isometric bottom and top views of a mounting base plate, constructed in accordance with an embodiment of the invention.
Figure 8B:
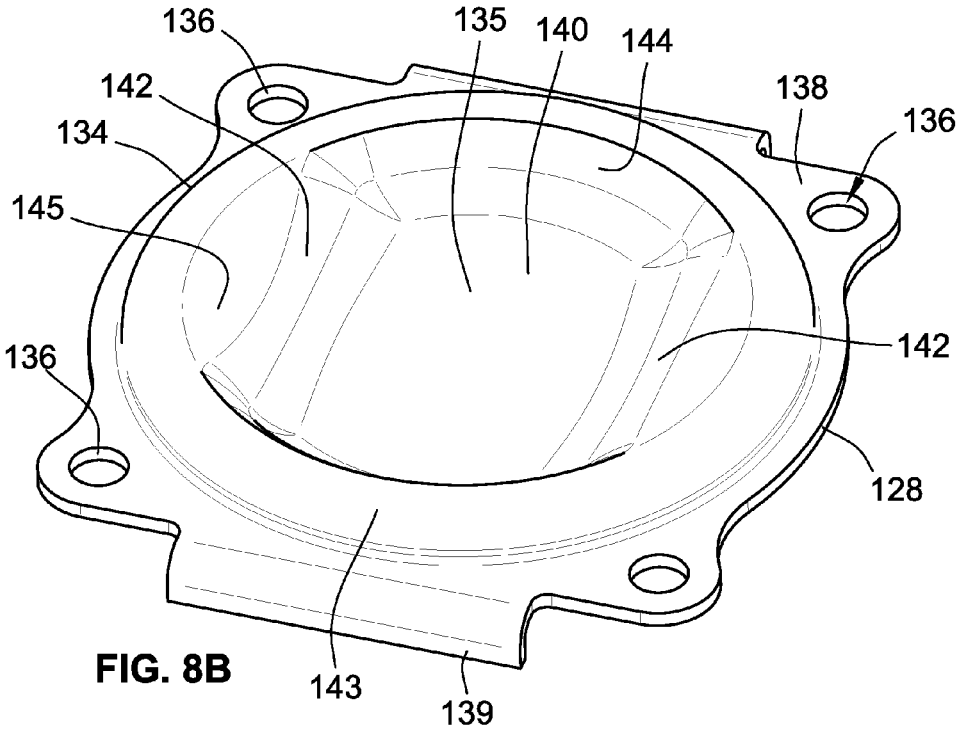
Figure 9A:
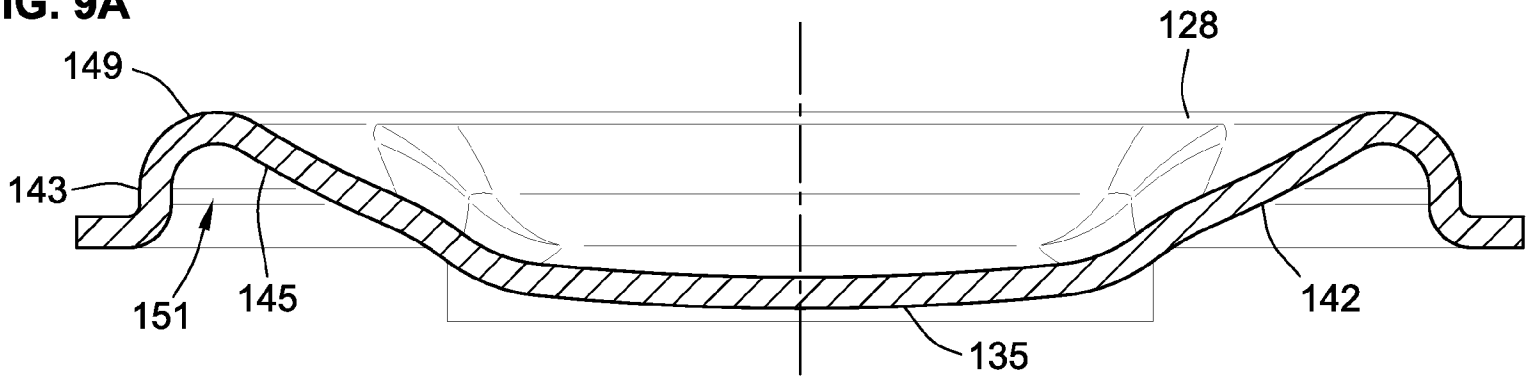
FIGS. 9A and 9B are cross-sectional views of the mounting base plate of FIGS. 8A and 8B.
Figure 9B:
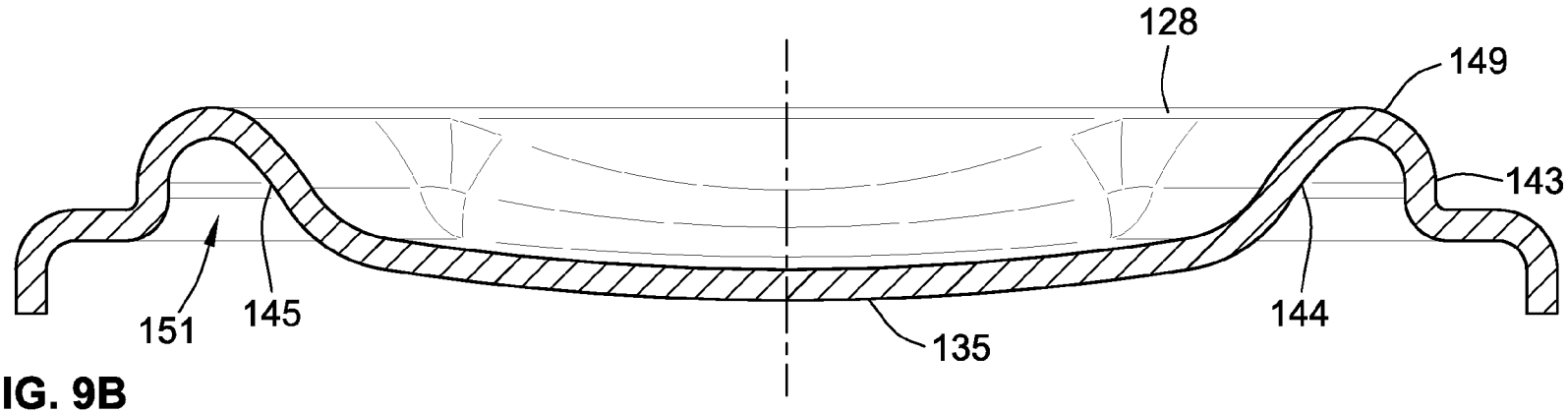

FIGS. 8A and 8B are isometric views of the bottom and top of an alternate embodiment of a mounting base plate 128 that can be used and may be the same as baseplate 28 shown in FIG. 5, while FIGS. 9A and 9B are cross-sectional view of the mounting base plate 128. Similar to the embodiment of FIGS. 4 and 5, this alternate embodiment of the mounting base plate 128 has a generally planar mounting surface 138 with two downward-facing stiffening flanges 139, and four openings 136 in each corner of the mounting surface 138. An annular rib 134, which, in certain embodiments, may be stamped from sheet metal, is bounded on the outside by the mounting surface 138, and on the inside by a central dome that includes a convex center portion 135, which provides a convex bottom to an oil sump. The annular rib 134 has an annular outer wall 143, annular inner wall 145 (which also defines part of the inner dome structure), annular apex 149, and annular channel 151.

However, unlike the rounded center portion 35 of FIG. 5, the center portion 135, while still convex, has a somewhat flattened but still convex bottom portion 140, and angled side portions 142, 144. The angled portions 142, 144 are designed to add lateral strength to the mounting base plate 128, and provide strengthening ribs formed into the sheet metal that are either linear or arcuate formed into what would otherwise be a smooth dome. In particular embodiments of the invention illustrated in FIGS. 8A and 8B, there are two angled side portions 142 which are on opposite sides of the center portion 135. Angled side portions 142 may have a generally linear profile when viewed in cross-section, though, in some embodiments such as shown in FIG. 9A, angled side portions 142 may be slightly concave, and thus curved in the opposite direction of the convex center portion 135. Angled side portions 144 are on opposite sides of the center portion 135 between angled side portions 142. Triangular gussets at corners connect adjacent ones of the angled side portions 144, 142. As illustrated, the angled side portions 144 have a generally linear profile, when viewed in cross-section such as that of FIG. 9B. It can be seen from FIGS. 9A and 9B that the annular inner wall 145 forms part of the angled side portions 142, 144. It should be understood that, while FIGS. 8A and 8B show two pairs of angled side portions 142, 144, embodiments of the invention include those where the center portion 135 has only one pair of opposed angled side portions, such as angled side portions 142. In such an embodiment, the opposing sides of the center portion 135 adjacent to the one pair of opposed angled side portions could be convex or rounded, unlike the angled side portions. In this manner, particular embodiments of the invention would include the somewhat flattened center portion 135 having one pair of opposing angled side portions and one pair of opposing convex or rounded side portions.

Referring again to FIG. 7, it can be seen that the compressor assembly 10 requires no additional mounting feet, mounting plates, adapters, and/or spacers to allow the compressor assembly to be mounted directly to the base rails 41 for an HVAC or refrigeration system. As can be seen, embodiments of the mounting base plate 28 allow the compressor assembly 10 to remain stable and upright when placed on a level surface or on a set of base rails 41 without using spacers, grommets, or mounting plates. This configuration for mounting of the compressor assembly permits for a reduction in the height and weight of the compressor(s) in the system as compared to that of conventionally constructed, and mounted, compressors. Further, the internal volume of the compressor assembly 10 is increased due to the convex center portion 35, as compared to conventional compressors using either flat bottomed end sections, or dome-shaped bottom end housing sections.

Referring again to FIG. 6, in a particular embodiment of the invention, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to a drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44.

Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

The lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from the oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

As can be seen in the embodiment of FIG. 6, the drive shaft 46 includes an impeller tube 47 attached at the bottom end of the drive shaft 46. In a particular embodiment, the impeller tube 47 is of a smaller diameter than the drive shaft 46, and is aligned concentrically with the central axis 54. The drive shaft 46 and impeller tube 47 pass through an opening in the cylindrical hub 58 of the lower bearing member 44. At its upper end, the drive shaft 46 is journaled for rotation within the upper bearing member 42. Hereinafter, the upper bearing member 42 is also referred to as a "crankcase".

In the exemplary embodiment shown in FIG. 6, the drive shaft 46 further includes an offset eccentric drive section 74 that has a cylindrical drive surface 75 (shown in FIG. 6) about an offset axis that is offset relative to the central axis 54. This offset drive section 74 is journaled within a central hub 129 of the movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided.

The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other compressor body 112, 110.

As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see FIG. 6). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

As shown in FIG. 6, the upper bearing member, or crankcase, 42 includes a central bearing hub 87 into which the drive shaft 46 is journaled for rotation, and a thrust bearing surface 96 that supports the movable scroll compressor body 112. Extending outward from the bearing hub 87 is a disk-like portion 86 that terminates in an intermittent perimeter support surface 88. The central bearing hub 87 extends below the disk-like portion 86, while the thrust bearing surface 96 extends above the disk-like portion 86. In certain embodiments, the intermittent perimeter support surface 88 is adapted to have an interference and press-fit with the outer housing 12.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A compressor assembly, comprising:

a housing that includes a plurality of attached shell sections which define an internal volume of the compressor;

compressor bodies disposed in the housing, the compressor bodies having respective surfaces which mutually engage;

a drive unit disposed in the housing, the drive unit having a motor to provide a mechanical output on a drive shaft, the drive shaft operatively driving the compressor bodies to facilitate relative movement for the compression of fluid;

wherein the plurality of shell sections includes a base plate having an annular rib which locates a tubular central shell section of the plurality of attached shell sections; and wherein a central portion of the base plate is generally convex along the outer surface of the housing, and has two pairs of opposing angled sides, with a first pair of opposing angled sides being slightly concave with respect to the central portion, wherein a second pair of opposing angled sides has a generally linear profile when viewed in cross-section, with the second pair of opposing angled sides being shorter and angled steeper than the first pair.

2. The compressor of claim 1, wherein the central portion of the base plate extends downward when the compressor is right side up.

3. The compressor assembly of claim 2, wherein the central portion of the base plate defines a lower boundary of an oil sump, and wherein the central portion of the base plate is bounded on its perimeter by the annular rib.

4. The compressor assembly of claim 2, wherein the central portion of the base plate has a flattened bottom portion surrounded by angled sides.

5. The compressor assembly of claim 1, wherein the base plate includes a mounting surface radially outboard of, and surrounding, the annular rib, and wherein the mounting surface abuts one end of the tubular central shell section such that the annular rib contacts an interior surface at a bottom end of the tubular central shell section.

6. The compressor assembly of claim 5, wherein the mounting surface of the base plate is generally flat, and wherein the base plate is welded to the tubular central shell section.

7. The compressor assembly of claim 6, wherein the annular rib projects upward from the mounting surface when the compressor is right side up.

8. The compressor assembly of claim 6, wherein the weld includes a circumferential weld joint located adjacent to an annular outer wall of the annular rib.

9. The compressor assembly of claim 5, wherein the mounting surface of the base plate mounts directly onto a set of base rails without a separate mounting plate.

10. The compressor assembly of claim 9, wherein the base plate includes at least one flange portion that extends either upward or downward from the mounting surface, wherein the base plate includes two flange portions, and wherein the set of base rails includes two substantially parallel base rails, and wherein the two flange portions extend between the two substantially parallel base rails.

11. The compressor assembly of claim 1, wherein the base plate is a single unitary part formed from sheet metal and that includes a plurality openings to accommodate fasteners for attaching the base plate to a set of base rails, wherein the base plate is generally rectangular having four corners, and wherein each corner has at least one of the plurality of openings.

12. The compressor of claim 1, wherein the base plate is configured to rest on a level surface or to be mounted onto a set of base rails without the use of grommets, spacers, or mounting feet.

13. The compressor of claim 1, wherein the base plate is a single unitary component part of sheet metal with the annular rib formed into the sheet metal, the annular rib includes an annular inner wall, an annular outer wall, and an annular apex which joins the annular inner wall to the annular outer wall.

14. The compressor of claim 13, wherein the annular rib further includes an annular channel located between the annular inner wall and annular outer wall, a portion of the annular channel defined by the annular apex.

* * * * *